United States Patent [19]

Takagi

[11] Patent Number: 4,760,710

[45] Date of Patent: Aug. 2, 1988

[54] ICE MAKING MACHINE

[75] Inventor: Akishito Takagi, Tokyo, Japan

[73] Assignee: Takagi Sangyo Yugen Kaisha, Tokyo, Japan

[21] Appl. No.: 41,058

[22] Filed: Apr. 22, 1987

[30] Foreign Application Priority Data

Nov. 14, 1984 [JP] Japan ..... 59-171716

[51] Int. Cl.[4] ..... F25C 1/14

[52] U.S. Cl. ..... 62/354; 165/133

[58] Field of Search ..... 62/354, 347, 348; 165/133

[56] References Cited

U.S. PATENT DOCUMENTS

| | | | |
|---|---|---|---|
| 2,280,320 | 4/1942 | Taylor | 62/354 X |
| 2,593,705 | 4/1952 | Sticelbar | 165/133 X |
| 2,867,987 | 1/1959 | MacLeod et al. | 62/347 X |
| 3,403,532 | 10/1968 | Knowles | 62/354 X |
| 4,044,797 | 8/1977 | Fujie et al. | 165/133 X |
| 4,075,868 | 2/1978 | Bartholmey | 62/354 X |
| 4,354,360 | 10/1982 | Fiske | 62/348 X |
| 4,510,768 | 4/1985 | Keller | 62/354 X |
| 4,580,410 | 4/1986 | Toya | 62/347 |
| 4,601,176 | 7/1986 | Suyama | 62/347 X |

FOREIGN PATENT DOCUMENTS 57-2376 1/1982 Japan .

*Primary Examiner*—William E. Tapolcai

*Attorney, Agent, or Firm*—Ladas & Parry

[57] ABSTRACT

An ice making machine having a cylindrical drum member whose inner wall is formed with surface irregularities. The ice making machine includes an adiabatic member which defines a cooling medium chamber relative to the inner wall. A rotary shaft is rotatably disposed in the drum member. The shaft has an upper portion provided with a water sprinkling pipe which is in fluid communication with a water tank through a water passage formed in the rotary shaft. A blade is fixedly secured to the shaft at a position confronting the cooling medium chamber. The cooling medium chamber is divided into a plurality of compartments to which cooling medium is respectively introduced.

7 Claims, 4 Drawing Sheets

ICE MAKING MACHINE

BACKGROUND OF THE INVENTION

The present invention relates to an ice making machine, and more particularly, to a type installed on a boat and capable of making large amount of ice from sea water.

Known is a drum type ice making machine which includes an upstanding drum covered with an adiabatic member. The drum has an inner wall provided with a cooling medium chamber through which cooling medium is recirculated. A hollow rotary shaft is rotatably disposed at a central portion of the drum, and water is sprinkled toward an inner peripheral surface of the drum through the rotary shaft. The sprinkled water is frozen at the drum inner surface during its downward travel therealong. Thus frozen ice is scraped by a blade fixedly secured to the rotary shaft, and is discharged from the lower portion of the drum.

According to the conventional ice making machine of this type, since the cooling medium passes from the upper to the lower portion of the cooling medium chamber, heat exchanging efficiency relative to the sprinkled water at the upper portion of the inner wall would be higher than that at the lower portion thereof, so that uniform freezing would not be attainable over the entire inner wall of the drum.

Further, according to the conventional device, a plurality of nozzles are radially formed along the length of the hollow rotary shaft, and water is ejected through these nozzles toward the drum wall, so that uniform water adhesion to the wall may not be obtainable, to thereby provide irregularity in freezing. As a result, freezing efficiency may be degraded. Furthermore, water not converted into ice may be disadvantageously dripped into the scraped ice and is mixed therewith.

In order to overcome the above-mentioned drawbacks, an improved ice machine is provided as described in Japanese Utility Model early publication No. 57-2376 (1982). In the publication are provided a plurality of cooling medium chambers arranged in vertical direction and between an outer adiabatic member and an inner wall, and cooling inlet and outlet are connected to each of the chambers. A hollow rotary shaft is rotatably disposed at the central portion of the drum. The upper portion of the shaft is connected to an output shaft of a driving motor through a power transmission mechanism, while the lower portion of the shaft is provided with a water passage connected, through a rotary joint, to a water supply pipe connected to a water tank. An ice scraping blade is fixedly secured to the rotary shaft at the side of the shaft and ranging the total axial lengths of the cooling medium chamber. A water sprinkling pipe radially outwardly extends from the upper portion of the rotary shaft, and has one end connected to the water passage. The other end of the water sprinkling pipe is positioned adjacent the upper portion of the inner drum surface, and is formed with a water sprinkling hole. At the lower portion of the drum is provided a gradually inclined surface whose lower end is connected to an annular recess for receiving water.

The improved ice making machine would be available for freezing ordinary sea water when the device is installed on a vessel or boat. However, such machine would not be sufficiently available for freezing sea water containing therein high salinity and/or impurities such as plankton and minerals. Further, even if the water is frozen at the drum wall, the frozen ice may be slippingly rotated relative to the drum wall by the rotational urging force of the blade, that is, the ice is rotated together with the rotation of the blade. Therefore, sufficient ice scraping operation and ice withdrawal may not be attainable.

SUMMARY OF THE INVENTION

It is therefore, an object of the present invention to overcome the above mentioned drawbacks and disadvantages, and to provide an improved ice making machine.

Another object of this invention is to provide such ice making machine capable of providing effective freezing over a drum wall, yet providing sufficient ice scraping efficiency.

Briefly, and in accordance with the present invention, an inner wall of the drum is formed with surface irregularities, such as a plurality of grooves each extending axial direction of the drum.

DETAILED DESCRIPTION OF THE PREFERRED EMBODIMENTS

Figure 1:
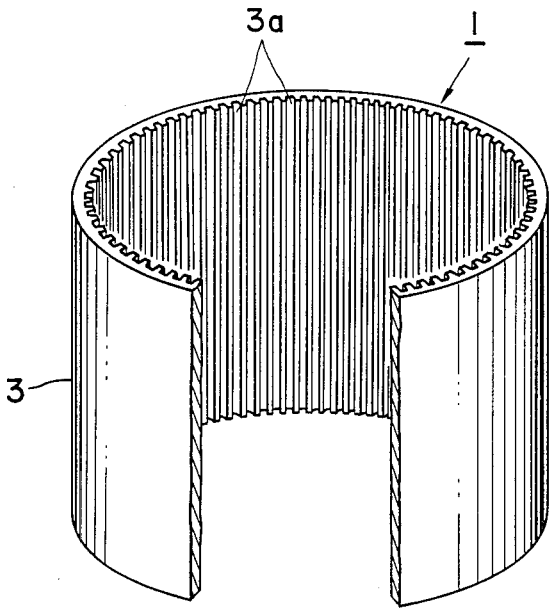
FIG. 1 is a perspective view showing a drum having an inner peripheral wall formed with grooves according to one embodiment of the present invention.
Figure 2:
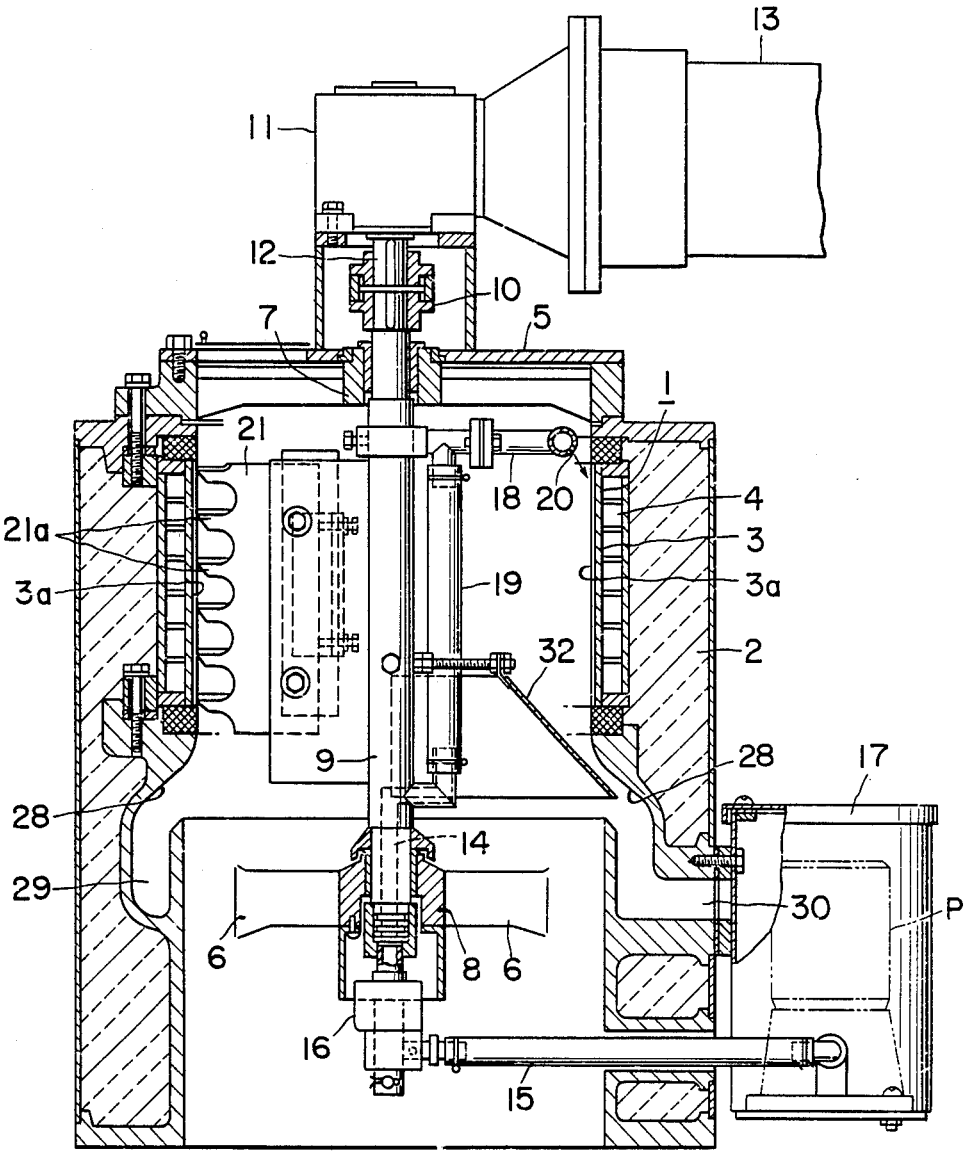
FIG. 2 is a vertical cross-sectional view showing an ice making machine according to the present invention.

One embodiment of the present invention will be described with reference to accompanying drawings. As best shown in FIG. 2, an upstanding cylindrical drum 1 has an outer peripheral surface covered with an adiabatic member 2, and a wall 3 is provided at an inner peripheral surface of the drum 1. A cylindrical cooling medium chamber 4 having a predetermined vertical length is defined between the wall 3 and the adiabatic member 2. As shown in FIG. 1, a plurality of grooves 3*a* are formed at the inner peripheral wall 3 of the drum 1, and extent in vertical direction along axial length of the wall 3 so as to enlarge heat conducting area of the surface of the drum 1.

A rotary shaft 9 is disposed at an axial central position of the drum 1, and is rotatably supported by bearings 7 and 8. The bearing 7 is provided at a lid member 5 which closes an upper open end of the drum 1, and the bearing 8 is provided at supporting arms 6, fixedly secured to a lower internal portion of the drum 1.

A gear box 11 is mounted on the lid member 5. The upper end portion of the rotary shaft 9 protrudes the lid member 5 and is connected to an output shaft 12 of the gear box through a coupling 10. The output shaft 12 is rotated about its axis by a motor 13 through a power transmission mechanism (not shown) assembled in the gear box 11.

A water passage 14 is formed in the lower portion of the rotary shaft 9. The passage 14 extends in axial direction of the shaft 9. A water supply pipe 15 extends in horizontal direction at a lower portion of the drum 1. The pipe 15 has one end in fluid communication with the water passage 14, yet allowing rotation of the shaft 9, through a rotary joint 16. The other end portion of the water supply pipe 15 extends to the exterior of the drum 1, and is connected to a lower portion of a water tank 17 positioned adjacent the drum 1. A pump P is provided to supply water in the tank 17 to the water supply pipe 15.

Within the drum 1, a plurality of water sprinkling pipes 18 extend from an upper end portion of the rotary shaft 9 in radial directions of the drum 1. The water sprinkling pipes 18 are in fluid communication with the water passage 14 through a water guide pipe 19 extending in a direction parallel with the rotary shaft 9. The distal end of each water sprinkling pipe 18 is positioned in a vicinity of the inner peripheral surface of the drum 1, i.e., the wall 3. A sprinkling opening 20 of the pipe 18 is oriented in a circumferential direction of the drum.

Figure 7:
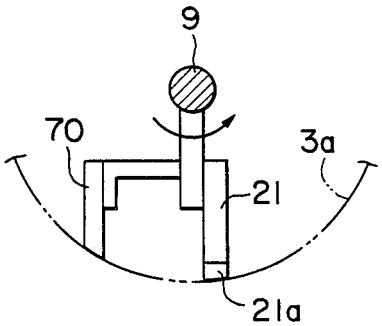
FIG. 7 is a plan view showing a state where an ice scraping blade and an ice scraping plate are disposed.
Figure 8:
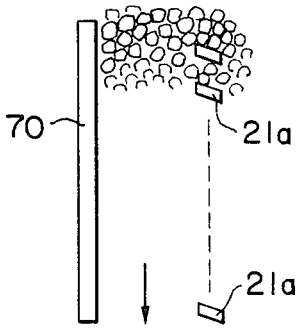
FIG. 8 is a side elevational view showing a state where an ice scraping blade and an ice scraping plate are disposed.

An ice scraping blade 21 extends from the rotary shaft 9 in a radial direction of the drum 1, and has a length corresponding to the axial length of the cooling medium chamber 4. Free end of the blade 21 is provided with a plurality of blade tips 21*a*, each being in contact with the inner peripheral surface of the drum 1, so that frozen ice formed on the inner peripheral surface of the drum 1 is scraped by the blade tips 21*a* upon rotation of the shaft 9. An ice scraping plate 70 is provided behind the ice scraping blade 21 in the rotatational direction of the rotary shaft 9 as shown in FIG. 7. As shown in FIG. 8, each of the blade tips 21*a* is slantingly provided, so that the blade tips 21*a* (leading side) scrape the ice on the wall 3 and urge the scraped ice upwardly, and the plate 70 (trailing side) removes the scraped ice from the wall 3.

Figure 3:
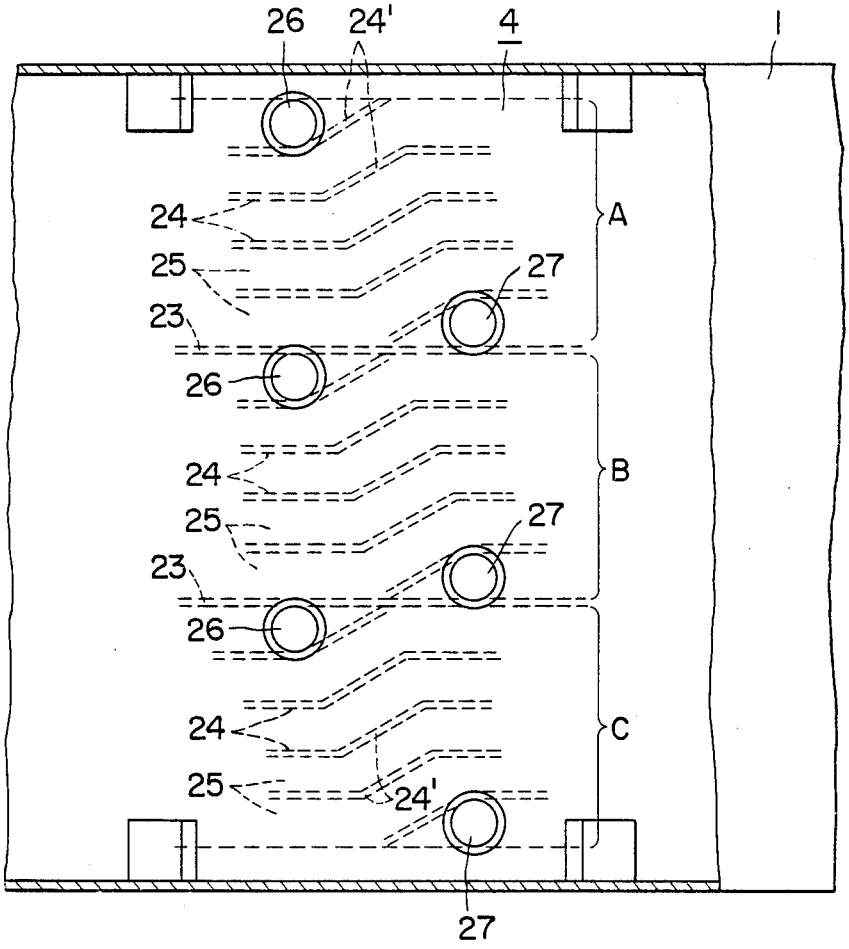
FIG. 3 is a partial explanatory diagram showing a drum part eliminating grooved portion for simplicity.

As best shown in FIG. 3, the cooling medium chamber 4 at the drum 1 is divided by annular partition members 23, 23 into a plurality of compartments A, B, and C, those being positioned at upper, intermediate and lower portions of the chamber 4, respectively. In each of the compartments, spiral partition plate 24 is provided to define a cooling medium passage 25. The partition plate 24 extends in circumferential direction and provides a constant spiral pitch in vertical direction of the drum.

A part of the partition plate 24 is obliquely directed to connect upper spiral passage 25 to the subsequent lower spiral passage 25. Cooling medium inlet pipe 26 and cooling medium outlet pipe 27 are connected at the upper and lower ends of the passage 25 with respect to each of the compartments A, B, C.

Turning back to FIG. 2, the lower portion of the inner surface of the drum 1 is formed with a downwardly tapered portion 28 which gradually increases its diameter toward the drum bottom. The tapered portion is positioned below the cooling medium chamber 4. Further, water withdrawal annular recess 29 is formed below the tapered portion to collect water. The recess bottom at its water tank side is positioned lower than that at diametrically opposite side and the lowest bottom portion is formed with a water discharge port 30 connected to an upper portion of the water tank 30, whereby water dripped and introduced into the annular recess 29 can be returned to the water tank 17.

Figure 4:
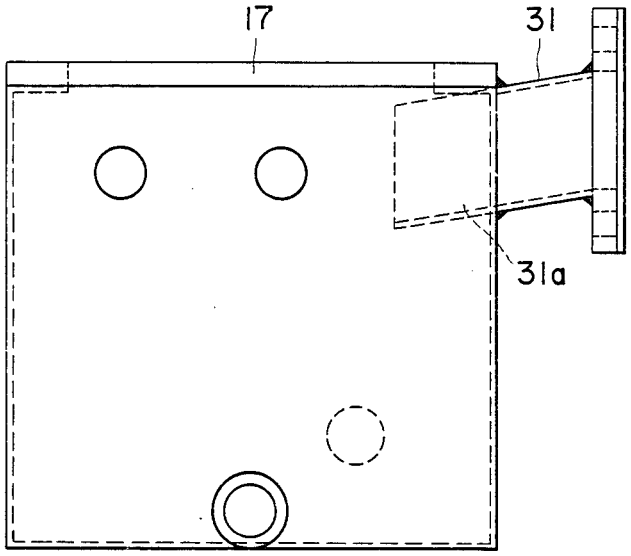
FIG. 4 is a schematic illustration showing a water tank and a connecting part to the drum, those used in the present invention.

FIG. 4 shows fluid connection between the water tank 17 and the discharge port 30. As shown, the port 30 is connected to the tank 17 by way of a slant pipe 31 which downwardly extends from the port 30 to the tank 17. A tip end 31*a* of the slant pipe 31 is protruded into an interior of the tank 17. With this structure, backflow of water from tank 17 to the port 30 can be eliminated even if the tank 17 is subjected to rolling motion due to boat rolling. In the drum 1, a deflector plate 32 is secured to the rotary shaft 9 so as to direct dripped water toward the annular recess 29. The deflector plate 32 has a hollow frusto-conical configuration, and is cut away at position where the blade 21 and plate are provided.

Figure 5:
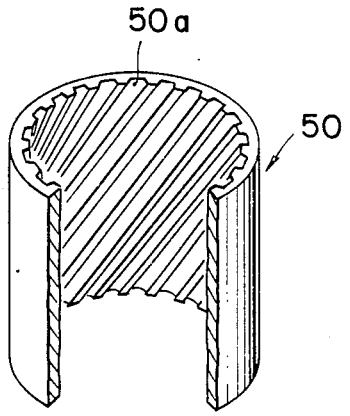
FIG. 5 is a perspective view showing a drum surface according to another embodiment of the present invention; and, FIG. 6 is a perspective view showing a drum surface according to still another embodiment of the invention.
Figure 6:
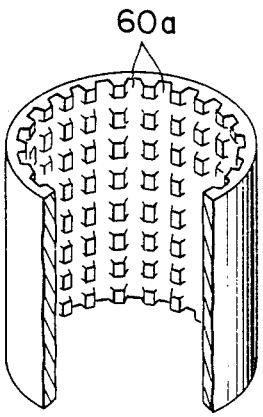

In the embodiment shown in FIG. 1, a plurality of grooves 3*a* formed at the inner peripheral surface of the drum 1 extend in parallel with one another in axial direction thereof. However, a plurality of grooves 50*a* may extend obliquely on the inner peripheral wall of the drum 50 as shown in FIG. 5. Further, instead of linear grooves, dimple or emboss pattern 60*a* or corrugated recesses would also be available as shown in FIG. 6. This may be a combination of two groups of the plurality of parallel grooves extending opposite direction and intersecting with each other.

In operation, cooling medium is supplied from the cooling medium inlet pipes 26, 26, 26 of the respective compartments A B C, so that the medium spirally passes through the respective passages 25 and is reached to the cooling medium outlet pipe 27. Of course, cooling medium thus flowed is recirculated again by means of a pump (not shown).

Thereafter, the motor 13 and the pump P are energized, so that the rotary shaft 9 is rotated about its axis through the power transmission mechanism in the gear box 11, and at the same time, water is supplied to the water sprinkling pipe 18 through the water supply pipe 15, the rotary joint 16, the water passage 14, and the water guide pipe 19, so that the water is sprinkled from the sprinkling opening 20 toward the drum internal surface.

The sprinkled water enters the grooves 3*a* formed on the surface of the wall 3, and is subjected to rapid cooling and freezing during its downward travel in the grooves by heat exchange relative to the cooling medium running through the cooling medium chamber 4. In this case, prompt and uniform cooling and freezing is attainable over the entire inner surface of the drum wall, regardless of the water impinging locations on the drum, since uniform cooling is conducted over the drum interior because of subdivided cooling medium recirculations each being independent of neighbouring compartments.

Particularly, the water applied within the grooves 3*a* is easily affixed to the grooves because of its large contact area, to thereby reduce water dripping velocity. Further, such water is promptly frozen because of large heat conductive area. Therefore, also available for rapid freezing is sea water which contains relatively high salinity and/or impurities such as plankton and minerals.

Upon rotation of the rotary shaft 9, frozen ice formed over the inner peripheral surface of the drum 1 is scraped or crushed by the blade 21, and is dropped toward the bottom of the drum 1. Thus scraped ice is collected when desired. During this scraping, since the frozen ice is fixed to the drum in such a manner that the ice bites into the grooves, the ice can be efficiently scraped and released from the drum surface by the blade without rotation of the ice concurrent with the rotation of the blade.

Further, sprinkled water not being subjected to freezing is dropped and reaches to the annular recess 29 along the tapered surface 28. The water is returned to the water tank 17 through the discharge port 30 and discharge pipe 31, and again introduced into the pipe 15 for reuse.

As described above, according to the ice making machine of the type in which the cooling medium chamber is provided along the drum inner surface, and the chamber is divided vertically into a plurality of compartments through which cooling medium is respectively recirculated, a plurality of grooves are formed on the inner peripheral surface of the drum, and the grooves extend from the upper to the lower portion of the drum, so that large heat conductive area is obtainable at the drum surface. Accordingly, freezing period can be minimized to promote freezing efficiency even by the application of sea water containing therein high salinity and/or impurities.

Further, since the frozen ice bites into the grooves, effective ice scraping is attainable eliminating ice slipping rotation urged by simultaneous blade rotation.

While the invention has been described in detail and with reference to specific embodiment thereof, it is apparent for those skilled in the art that various changes and modifications can be made without departing from the scope and spirit of the invention.

What is claimed is:

1. An ice making machine comprising: a drum member having an inner wall, said inner wall being formed with surface irregularities over the entire inner peripheral surface thereof; an adiabatic member disposed at an outer peripheral surface of said drum, said inner wall and said adiabatic member defining a cooling medium chamber divided into a plurality of compartments; a plurality of cooling medium inlet and outlet pipes each connected to respective one of said compartments; a rotary shaft rotatably disposed at a central portion of said drum member; a drive member for driving said rotary shaft about its axis; an ice scraping blade fixed to said rotary shaft and extending along a length of said cooling medium chamber; an ice scraping plate following said ice scraping blade and fixed to said rotary shaft; a water sprinkling means for sprinkling water onto said inner wall of said drum; and, a water supply means for feeding water from a water tank to said water sprinkling means.

2. An ice making machine as claimed in claim 1, wherein said surface irregularities are in a form of a plurality of grooves extending in parallel with one another in an axial direction of said drum member.

3. An ice making machine as claimed in claim 1, wherein said surface irregularities are in a form of plurality of grooves extending in parallel with each other in a direction oblique to an axial direction of said drum member.

4. An ice making machine as claimed in claim 1, wherein said surface irregularities are in a form of dimple or emboss pattern.

5. An ice making machine as claimed in claim 1, wherein said sprinkling means comprises a sprinkling pipe extending radially from an upper portion of said rotary shaft.

6. An ice making machine as claimed in claim 5, wherein said water supply means comprises a water supply pipe having one end connected to a lower end of said rotary shaft through a rotary joint, and having the other end connected to said water tank; and a water passage formed in said rotary shaft for feeding water from said water supply pipe to said sprinkling pipe.

7. An ice making machine as claimed in claim 1, wherein said drum is formed with a gradually radially outwardly inclined portion at its lower inner peripheral surface in such a manner that an annular recess is connected to the lower end of said inclined portion.

* * * * *